US009130279B1

(12) United States Patent
Lee et al.

(10) Patent No.: US 9,130,279 B1
(45) Date of Patent: Sep. 8, 2015

(54) MULTI-FEED ANTENNA WITH INDEPENDENT TUNING CAPABILITY

(71) Applicant: AMAZON TECHNOLOGIES, INC., Reno, NV (US)

(72) Inventors: Tzung-I Lee, San Jose, CA (US); In Chul Hyun, San Jose, CA (US); Cheol Su Kim, San Jose, CA (US); Jerry Weiming Kuo, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 260 days.

(21) Appl. No.: 13/789,455

(22) Filed: Mar. 7, 2013

(51) Int. Cl.
*H01Q 1/24* (2006.01)
*H01Q 21/28* (2006.01)
*H01Q 1/50* (2006.01)

(52) U.S. Cl.
CPC . *H01Q 21/28* (2013.01); *H01Q 1/50* (2013.01)

(58) Field of Classification Search
CPC ..... H01Q 1/243; H01Q 1/48; H01Q 5/0055
USPC ..... 343/702, 700 MS, 728
See application file for complete search history.

(56) References Cited

U.S. PATENT DOCUMENTS

| | | | | |
|---|---|---|---|---|
| 8,648,756 | B1 * | 2/2014 | Desclos et al. | 343/747 |
| 8,854,267 | B2 * | 10/2014 | Kim et al. | 343/702 |
| 2002/0105474 | A1 * | 8/2002 | Kitamura et al. | 343/850 |
| 2006/0232483 | A1 * | 10/2006 | Iwai et al. | 343/702 |
| 2008/0180333 | A1 * | 7/2008 | Martiskainen et al. | 343/722 |
| 2009/0009401 | A1 * | 1/2009 | Suzuki et al. | 343/700 MS |

* cited by examiner

*Primary Examiner* — Hoanganh Le
(74) *Attorney, Agent, or Firm* — Lowenstein Sandler LLP

(57) ABSTRACT

Antenna structures and methods of operating the same of a multi-feed antenna of an electronic device are described. A multi-feed antenna includes a first antenna element coupled to a first tuner circuit that is coupled a first radio frequency (RF) feed, and a second antenna element coupled to a second tuner circuit that is coupled to a second RF feed. The first tuner circuit is programmable to independently adjust a first impedance of the first antenna element and the second tuner circuit is programmable to independently adjust a second impedance of the second antenna element.

20 Claims, 13 Drawing Sheets

MULTI-FEED ANTENNA WITH INDEPENDENT TUNING CAPABILITY

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high-band. One resonant mode in the lower frequency band and one resonant mode in the high-band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
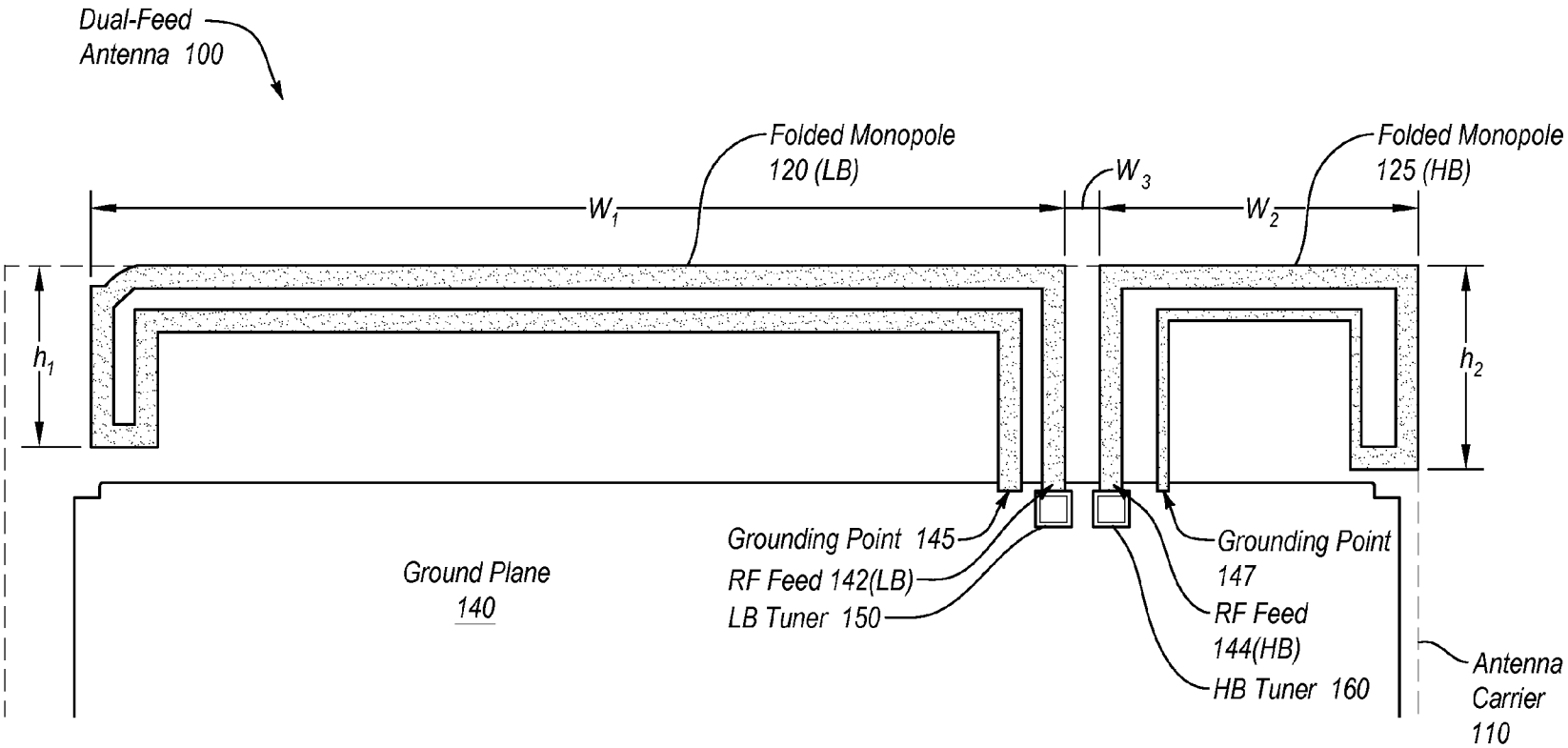
FIG. 1 illustrates one embodiment of a dual-feed antenna including two folded monopole structures coupled to independent tuner circuits.

Antenna structures and methods of operating the same of a multi-feed antenna of an electronic device are described. One multi-feed antenna includes a first tuner circuit, a first RF feed, a second tuner circuit, a second RF feed and a dual-feed antenna. The dual-feed antenna includes a first folded monopole structure coupled to the first RF feed and a second folded monopole structure coupled to the second RF feed. The first tuner circuit is configured to independently adjust a first impedance of the first folded monopole structure to achieve a first frequency response and the second tuner circuit is configured to independently adjust a second impedance of the second folded monopole structure to achieve a second frequency response that is substantially isolated from the first frequency response. That is, the first tuner circuit can adjust the impedance of a first antenna element independent from the second tuner circuit adjusting the impedance of a second antenna element. Embodiments of multi-feed antennas with independent tuning capability increase isolation between the multiple antenna elements of the multi-feed antennas. For example, when doing impedance tuning on a single-feed antenna the covers a low band and a high band, changing the low band impedance causes impedance change in the high band, or vice versa. The independent tuner circuits of the multi-feed antenna structures described herein can independently adjust the impedance for the low band and the high band so that adjusting one does not cause impedance change in the other as occurs in the single-feed antenna. Another multi-feed antenna includes a first tuner circuit, a first RF feed, a second tuner circuit, a second RF feed, a third tuner circuit, a third RF feed and a multi-feed antenna. The multi-feed antenna includes a monopole structure coupled to the first RF feed, a loop structure coupled to the second RF feed and a coupled monopole structure coupled to the third RF feed. The first tuner circuit, second tuner circuit and third tuner circuit are configured to independently adjust a first impedance of the monopole structure, a second impedance of the loop structure and a third impedance of the coupled monopole structure, respectively, to increase isolation between the monopole structure, loop structure and the coupled monopole structure.

In a multi-feed antenna, both bandwidth and efficiency in the high-band can be limited by the space availability and coupling between the high-band antenna and the low-band antenna in a compact electronic device. The independent tuner circuits can be used to improve radiation efficiency by controlling the impedance of each of the antenna elements independently. The tuner circuits allow the multi-feed antenna to be an impedance controlled, multi-feed antenna. It should also be noted that the embodiments depicted are folded monopoles, monopoles, coupled monopoles, loops; however, in other embodiments any type of antenna structure can be used, such as, for example, inverted-F antenna (IFA), slot or the like.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

FIG. 1 illustrates one embodiment of a dual-feed antenna 100 including two folded monopole structures coupled to independent tuner circuits. The dual-feed antenna 100 includes a first folded monopole structure 120 coupled to a first RF feed 142 (LB feed) that is coupled to a first tuner circuit 150 (LB tuner). The dual-feed antenna 100 also includes a second folded monopole structure 125 coupled to a second RF feed 144 (HB feed) that is coupled to a second tuner circuit 160 (HB tuner).

In FIG. 1, the ground is represented as a radiation ground plane 140. The ground plane 140 may be a metal frame of the electronic device. The ground plane 140 may be a system ground or one of multiple grounds of the user device. The first RF feed 142 and second RF feed 1422 may be feed line connectors that couple the dual-feed antenna 100 to respective feed lines (also referred to as the transmission lines), which are physical connections that carries the RF signals to and/or from the dual-feed antenna 100. The feed line connectors may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the first folded monopole structure 120 and the first tuner circuit 150 and another feed line connector is directly connected to the second folded monopole structure 125 and the second tuner circuit 160. The first folded monopole structure 120 is coupled to the ground plane 140 at a grounding point 145 at a distal end of the first folded monopole structure 120, the distal end being the end farthest from the first RF feed 142. The second folded monopole structure 125 is coupled to the ground plane 140 at a grounding point 147 at a distal end of the second folded monopole structure 125. Alternatively, other configurations of the dual-feed antenna 100 are possible as would be appreciated by one of ordinary skill in the art having the benefit of this disclosure.

In one embodiment, the dual-feed antenna 100 is disposed on an antenna carrier 110, such as a dielectric carrier of the electronic device. The antenna carrier 110 may be any non-conductive material, such as dielectric material, upon which the conductive material of the dual-feed antenna 100 can be disposed without making electrical contact with other metal of the electronic device. In another embodiment, the dual-feed antenna 100 is disposed on, within, or in connection with a circuit board, such as a printed circuit board (PCB). In one embodiment, the ground plane 140 may be a metal chassis of a circuit board. Alternatively, the dual-feed antenna 100 may be disposed on other components of the electronic device or within the electronic device as would be appreciated by one of ordinary skill in the art having the benefit of this disclosure. It should be noted that the dual-feed antenna 100 illustrated in FIG. 1 is a two-dimensional (2D) structure. However, as described herein, the dual-feed antenna 100 may include three-dimensional (3D) structures, as well as other variations than those depicted in FIG. 1.

During operation, the first tuner circuit 150 is programmable to independently adjust a first impedance of the first folded monopole structure 120 and the second tuner circuit 160 is programmable to independently adjust a second impedance of the second folded monopole structure 125. The first and second impedances can be independently tuned to increase isolation between the first folded monopole structure 120 and the second folded monopole structure 125.

In one embodiment, the first folded monopole structure 120 is configured to radiate electromagnetic energy in a first frequency range (e.g., low-band) and the second folded monopole structure 125 is configured to radiate electromagnetic energy in a second frequency range (e.g., high-band), which is higher than the first frequency range. In one embodiment, the first frequency range is between approximately 700 MHz to approximately 960 MHz and the second frequency range is between approximately 1.7 GHz to approximately 2.2 GHz. In another embodiment, the first frequency range is between approximately 700 MHz to approximately 960 MHz and the second frequency range is between approximately 1.7 GHz to approximately 2.7 GHz. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes, for example, a first high-band mode and a second high-band mode. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a multi-feed antenna with increased bandwidth in a size that is conducive to being used in a user device.

In the depicted embodiment, the first folded monopole structure 120 includes a first length that extends from the first RF feed 142 to the first grounding point 145 where the first folded monopole structure 120 is coupled to the ground plane 140. The second folded monopole structure 125 includes a second length that extends from the second RF feed 144 to the second grounding point 147 where the second folded monopole structure 125 is coupled to the ground plane 140. The first length is longer than the second length. In another embodiment, the first folded monopole structure 120 has an effective width (W1)

The dual-feed antenna 100 may have various dimensions based on the various design factors. In one embodiment, the dual-feed antenna 100 has an overall height (h), an overall width (W), and an overall depth (d). The overall height (h) may vary, but, in one embodiment, is about 10 mm. The overall width (W) may vary, but, in one embodiment, is about 58 mm. The overall depth may vary, but, in one embodiment, is about 0 mm since the dual-feed antenna 100 is 2D. In one embodiment, the overall depth may be 4 mm and portions of the dual-feed antenna 100 can be wrapped around different sides of the antenna carrier 110. The first folded monopole structure 120 has a width ($W_1$) that may vary, but, in one embodiment, is 42 mm. The first folded monopole structure 120 has a height ($h_1$) that may vary, but, in one embodiment, is 8 mm. The second folded monopole structure 125 a width ($W_2$) that may vary, but, in one embodiment, is 14 mm. The second folded monopole structure 125 a height ($h_2$) that may vary, but, in one embodiment, is 9 mm. The dual-feed antenna 100 may have a gap with a width (W3) that may vary, but, in one embodiment, is 1.5 mm.

In one embodiment, the first antenna element is a first folded monopole structure 120 that includes multiple portions: a first portion that extends from the first RF feed 142 in a first direction to a first fold; a second portion that extends from the first fold in a second direction to a second fold; a third portion that extends from the second fold in a third direction to a third fold; a fourth portion that extends from the third fold in a fourth direction to a fourth fold and is laid out at least partially in parallel to the second portion; and a fifth portion that extends from the fourth fold in a fifth direction to the ground plane 140 and is laid out at least partially in parallel to the first portion. In the depicted embodiment, the first folded monopole structure 120 has a section at a distal end of the first folded monopole structure 120 that is folded in the third direction towards the ground plane 140. This can be done to fit the folded monopole structure in a smaller volume while maintaining the overall length of the first folded monopole structure 120. It should be noted that a "fold" refers to a bend, a corner or other change in direction of the antenna element. For example, the fold may be where one segment of an antenna element changes direction in the same plane or in a different plane. Typically, folds in antennas can be used to fit the entire length of the antenna within a smaller area or smaller volume of a user device. In this embodiment, the first tuner circuit 150 is disposed at a proximal end of the first portion, the proximal end being the nearest to the first RF feed 142.

In one embodiment, the second antenna element is a second folded monopole structure 125 that includes multiple portions: a first portion that extends from the second RF feed 144 in a first direction to a first fold; a second portion that extends from the first fold in a second direction to a second fold; a third portion that extends from the second fold in a third direction to a third fold; a fourth portion that extends from the third fold in a fourth direction to a fourth fold and is laid out at least partially in parallel to the second portion; and a fifth portion that extends from the fourth fold in a fifth direction to the ground plane 140 and is laid out at least partially in parallel to the first portion. In the depicted embodiment, the second folded monopole structure 125 has a section at a distal end of the second folded monopole structure 125 that is folded in the third direction towards the ground plane 140. This can be done to fit the second folded monopole structure in a smaller volume as described above. In this embodiment, the second tuner circuit 160 is disposed at a proximal end of the first portion, the proximal end being the nearest to the second RF feed 144.

In this embodiment, the dual-feed antenna 100 is a 2D structure as illustrated in the front view of FIG. 1. In other embodiments, the first folded monopole structure 120, second folded monopole structure 125 and parasitic ground element 130 are 3D structures that can wrap around different sides of the antenna carrier 110. In particular, in the depicted embodiment, both the first folded monopole structure 120 and second folded monopole structure 125 are disposed in a first plane (e.g., front surface of the antenna carrier 110). However, in other embodiments, portions of the first folded monopole structure, second folded monopole structure, or both are disposed in one or more additional planes, such as, for example, a top surface of the antenna carrier 110. Of course, other variations of layout may be used as would be appreciated by one of ordinary skill in the art having the benefit of this disclosure.

In the depicted embodiment, the antenna types of the first and second antennas are the same, i.e., folded monopole structures. In another embodiment, the antenna types may be different combinations of monopole, dipole, patch, slot, loop antenna structures or the like as would be appreciated by one of ordinary skill in the art. It should also be noted that other shapes for the first folded monopole structure 120 are possible. For example, the first antenna element 122 and the second antenna element 124 can have various bends, such as to accommodate placement of other components, such as a speakers, microphones, USB ports. Similarly, other shapes for the second folded monopole structure 125 may be used.

Strong resonances are not easily achieved within a compact space within user devices, especially within the spaces on smart phones and tablets. The structure of the dual-feed antenna 100 provides strong resonances at a first frequency range of approximately 700 MHz to approximately 960 MHz and at a second frequency range of approximately 1.7 GHz to approximately 2.2 GHz. Alternatively, the structure of the dual-feed antenna 100 provides strong resonances at a first frequency range of approximately 700 MHz to approximately 960 MHz and at a second frequency range of approximately 1.7 GHz to approximately 2.7 GHz. These resonances can be operated in separate modes or may be operated simultaneously. Strong resonances, as used herein, refer to a significant return loss at those frequency bands, which is better for impedance matching to 50-ohm systems. These multiple strong resonances can provide an improved antenna design as compared to conventional designs.

In this embodiment, the dual-feed antenna 100 includes two antenna elements and two tuner circuits. In other embodiments, more antenna elements and tuner circuits can be used to configure the physical structure of a multi-feed antenna. In one embodiment, a third tuner circuit (illustrated and described with respect to FIG. 7) is coupled to a third antenna element coupled to a third RF feed. The third tuner circuit is programmable to independently adjust a third impedance of the third antenna element.

In one embodiment, the first tuner circuit 150 includes multiple passive components and one or more switches to selectively couple the passive components to adjust the first impedance. Similarly, the second tuner circuit 160 (and any additional tuner circuits) may also include multiple passive components and one or more switches to selectively couple the passive components to adjust the second impedance (and impedances of any additional antenna elements). Described below is one embodiment of a tuner circuit with respect to FIG. 2. Alternatively, other tuner circuits may be used to independently adjust the respective impedance of the respective antenna element.

Figure 2:
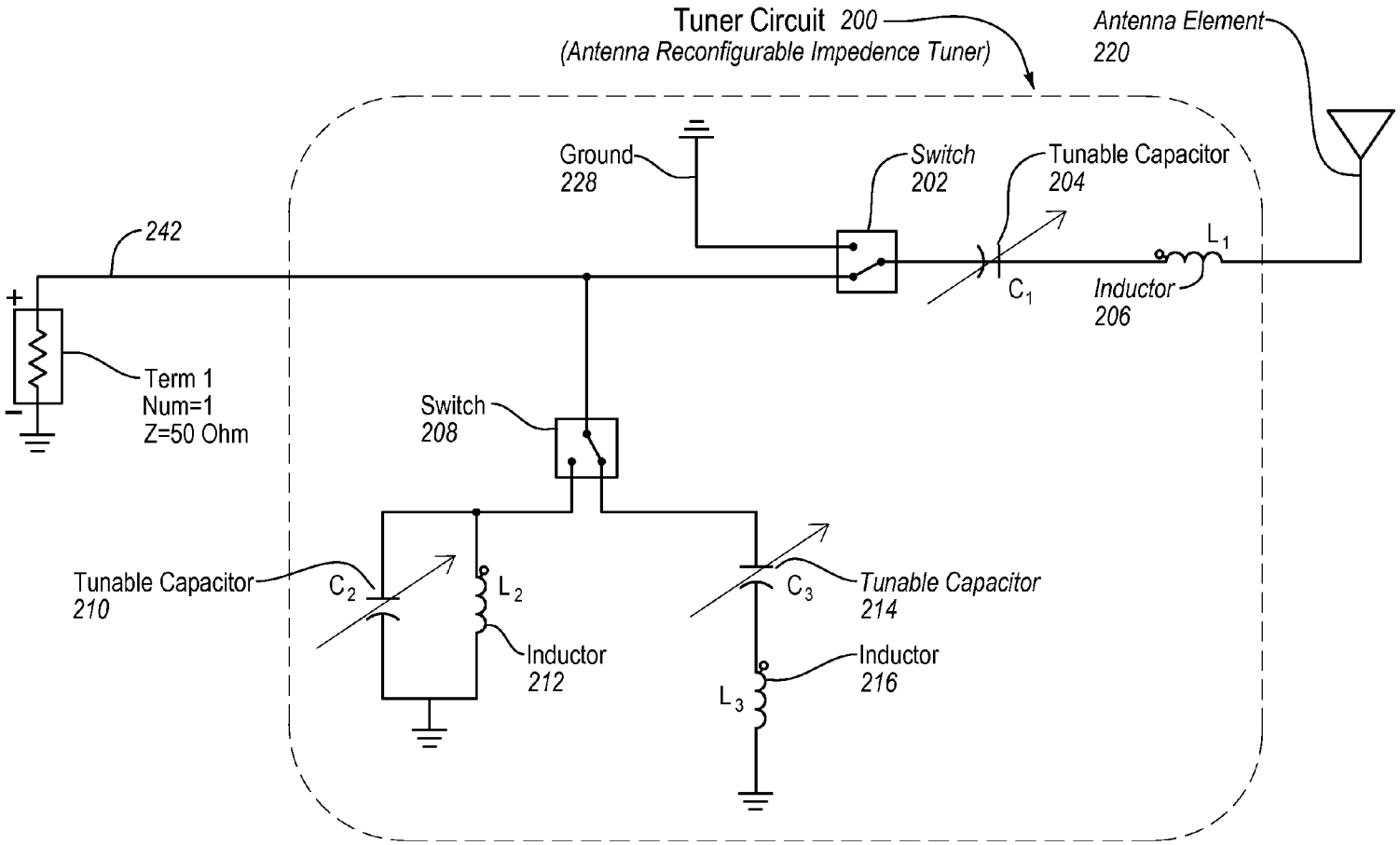
FIG. 2 is a circuit diagram of a tuner circuit according to one embodiment.

FIG. 2 is a circuit diagram of a tuner circuit 200 according to one embodiment. The tuner circuit 200 includes multiple tunable matching networks that can be selectively coupled between a terminal 242 and an RF feed that feeds an antenna element 220. These tunable matching networks can be selectively coupled in parallel or in series with the terminal 242. Different combinations of these tunable matching networks can be selectively coupled to achieve different impedances for the antenna element 220. In the depicted embodiment, the tuner circuit 200 is an antenna reconfigurable impedance tuner that includes a first switch 202 including inputs coupled to ground 228 and the terminal 242, a first tunable capacitor 204 ($C_1$) coupled to an output of the first switch 202, and a first inductor 206 ($L_1$) coupled to the first tunable capacitor 204 and the RF feed of the antenna element 220. When the first switch 202 is coupled to the terminal 242, the first tunable capacitor 204 ($C_1$) and the first inductor 206 ($L_1$) are coupled in series between the terminal 242 and the RF feed of the antenna element 220. The tuner circuit 200 also includes a second switch 208 including a first input coupled to a second tunable capacitor 210 ($C_2$) and a second inductor 212 ($L_2$) coupled in parallel relative to ground. The second switch 208 also includes a second input coupled to a third tunable capacitor ($C_3$) and a third inductor ($L_3$) that are coupled in series to ground. An output of the second switch 208 is coupled in parallel to the terminal 242. In the depicted embodiment, the capacitors are tunable capacitors. In other embodiments, the capacitors may not be tunable. The first switch 202 is configured to switch between the signal received on terminal 242 and ground 228. The first switch 202 can be controlled by a processing element, such as a wireless modem, a processing device, a controller or the like. A processing device, such as described herein, can be used to control the switches 202 and 208. For example, the processing device can use control signals to control the state of the switches 202 and 208. Alternatively, other circuits can be used for the tuner circuit to switch between the different configurations. In one embodiment, the processing element can determine a mode of operation of the device as a basis for the switching. For example, the processing element can determine that the device is to operate in a low band mode between about 700 MHz to 960 MHz and can control the switches 202, 208 to adjust the impedance for operation in the low band mode. The processing element can determine that the user device is to operate in a high band mode between about 1.7 GHz and about 2.2 GHz and can control the switches 202, 208 to adjust the impedance for operation in the high band mode. In another embodiment, the processing element can monitor a parameter that indicates that the device is operating in one of multiple modes and the processing element can adjust the impedance of the antenna element to correspond to the particular mode. That is different configurations of the tuner circuits can correspond to different modes of operations and the mode parameter can be the basis for switching between the different configurations of the tuner circuits. Similarly, the processing element may control the first tunable capacitors 204 to change an impedance of the antenna element 220. The second switch 208 is configured to switch between the parallel components and the series components. For example, the second switch 208 can use the second tunable capacitors 210 and the second inductor 212, which are coupled in parallel, to change the impedance of the antenna element 220. In addition to controlling the second switch 208 to selectively couple the second tunable capacitors 210 and the second inductor 212, the processing element can control the second tunable capacitor 210 to change the impedance of the antenna element 220. This can be done in connection with the control of the first tunable capacitors 204. For another example, the second switch 208 can use the third tunable capacitor 214 and the third inductor 216, which are coupled in series, to change the impedance of the antenna element 220. In addition to controlling the second switch 208 to selectively couple the third tunable capacitors 214 and the third inductor 216, the processing element can control the third tunable capacitor 214 to change the impedance of the antenna element 220. This can be done in connection with the control of the first tunable capacitors 204. In effect, the switches and the passive components can be programmed into different configurations and to have different capacitance values to vary the impedance of the antenna element 220. In other embodiments, additional passive components can be used to provide additional configurations to change the impedance of the antenna element 220. In these embodiments, tunable capacitors are considered passive components although there values can be varied. In other embodiments, the tuner circuit 200 may use active components in addition to, or in place of, the passive components.

Figure 7:
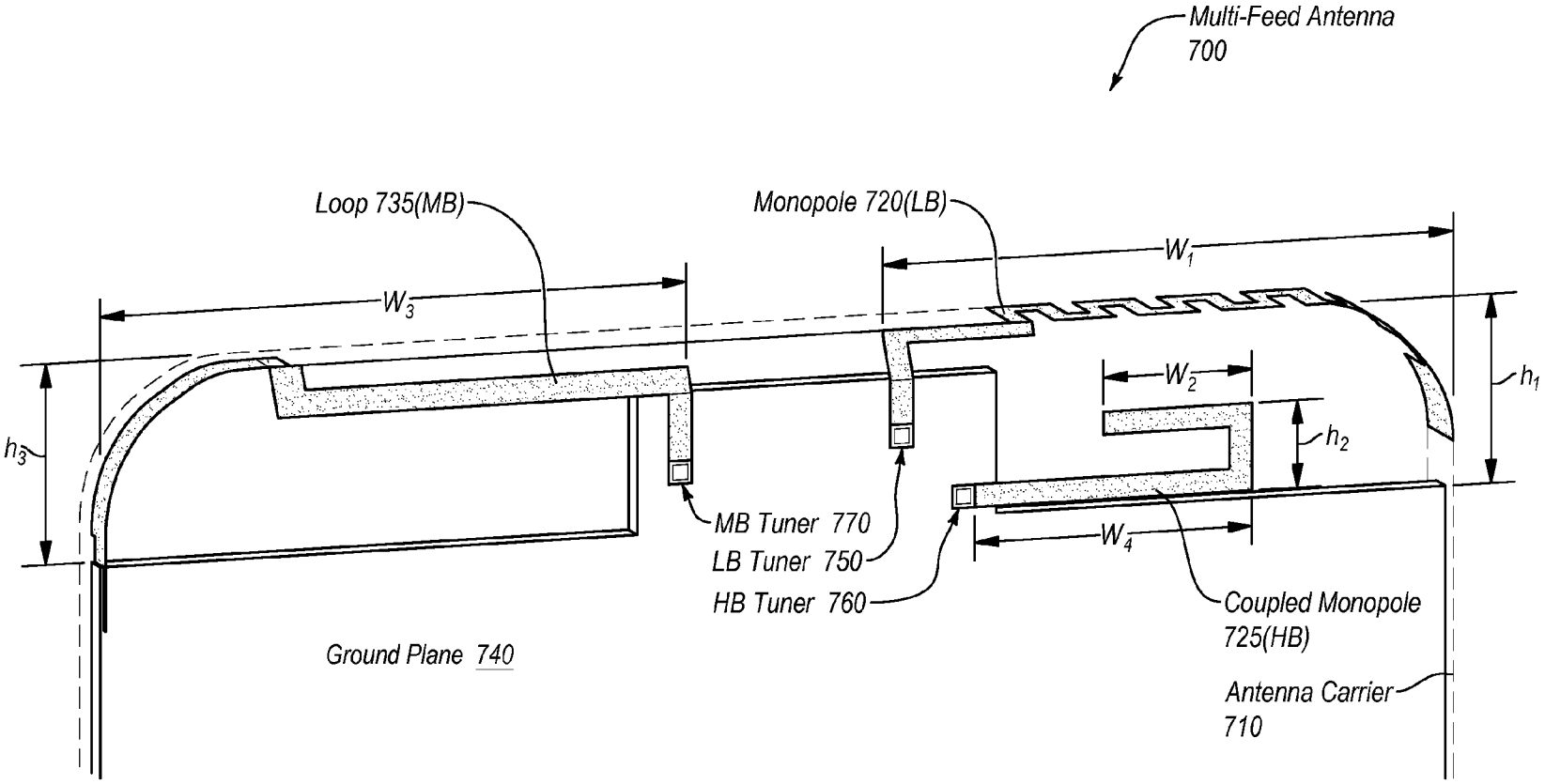
FIG. 7 illustrates another embodiment of a multi-feed antenna including a monopole structure, a coupled monopole structure, and a loop structure coupled to three independent tuner circuits, respectively.

In one embodiment, the tuner circuit 200 can be used for the first tuner circuit 150, the second tuner circuit 160, as well as additional tuner circuits, such as a third tuner circuit illustrated and described with respect to FIG. 7.

Figure 3:
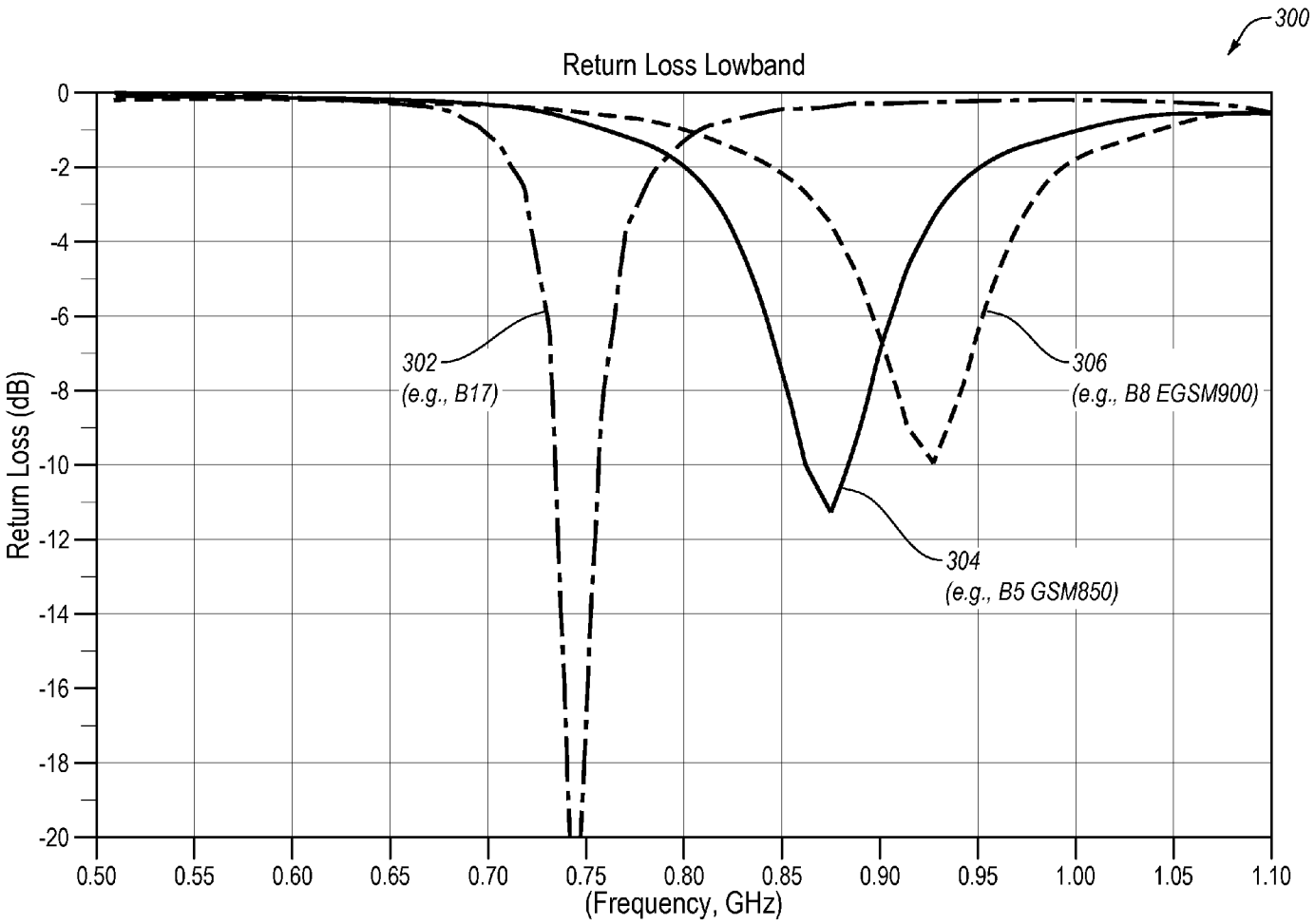
FIG. 3 is a graph of measured return loss of the first folded monopole structure of the dual-feed antenna of FIG. 1 tuned to three frequencies in a low-band according to one embodiment.

FIG. 3 is a graph 300 of measured return loss 302, 304, 306 of the first folded monopole structure 120 of the dual-feed antenna 100 of FIG. 1 tuned to three frequencies in a low-band according to one embodiment. The graph 300 shows the return loss 302 when the first frequency range of the first folded monopole structure 120 is tuned to be centered at approximately 740 MHz. The first frequency range can be tuned to radiate electromagnetic energy in Band 17, for example. The graph 300 shows the return loss 304 when the first frequency range of the first folded monopole structure 120 is tuned to be centered at approximately 875 MHz. The first frequency range can be tuned to radiate electromagnetic energy in Band 5 (e.g., GSM 850), for example. The graph 300 shows the return loss 306 when the first frequency range of the first folded monopole structure 120 is tuned to be centered at approximately 925 MHz. The first frequency range can be tuned to radiate electromagnetic energy in Band 8 (e.g., EGSM 900), for example.

Figure 4:
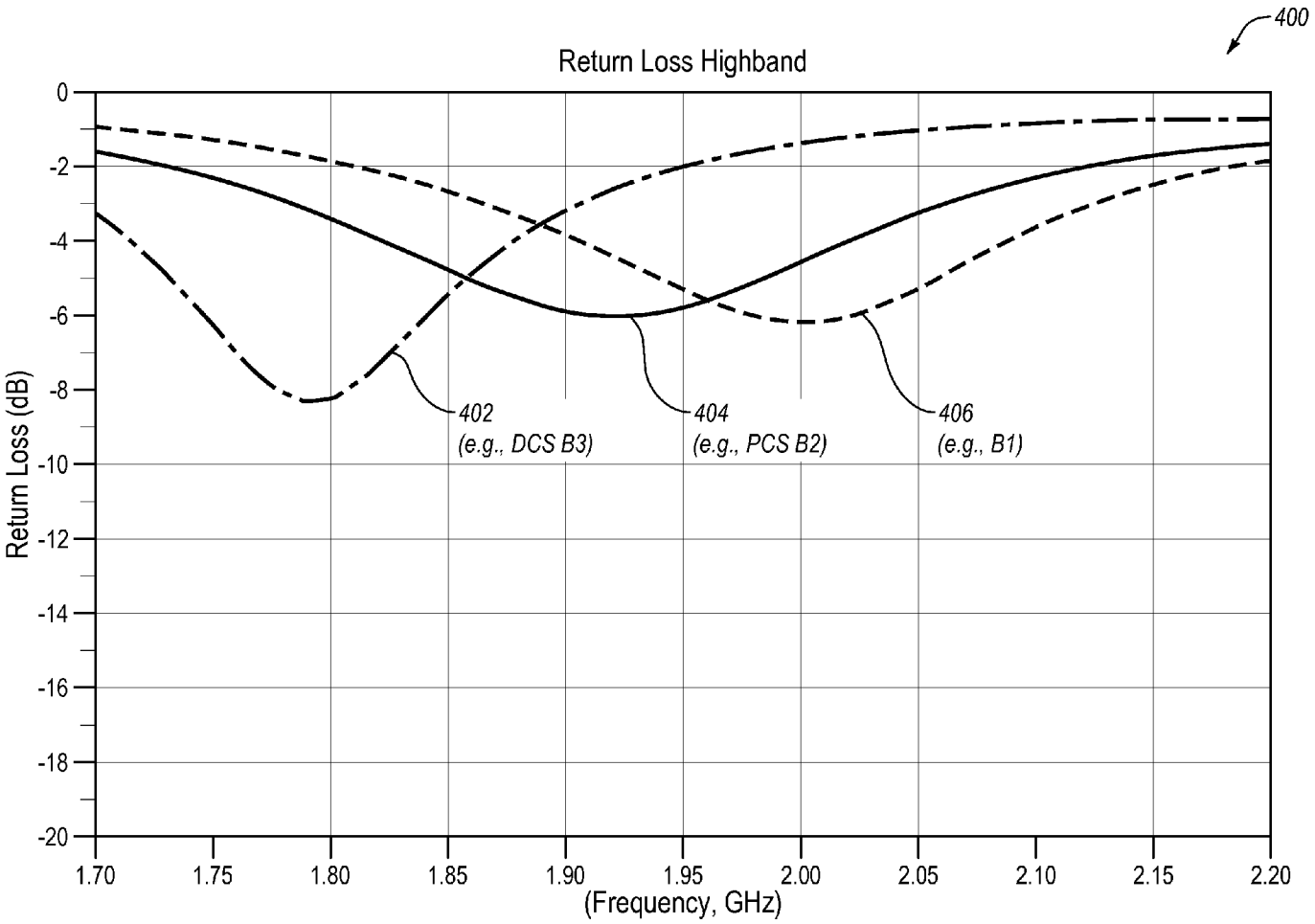
FIG. 4 is a graph of measured return loss of the second folded monopole structure of the dual-feed antenna of FIG. 1 tuned to three frequencies in a high-band according to one embodiment.

FIG. 4 is a graph 400 of measured return loss 402, 404, 406 of the second folded monopole structure 125 of the dual-feed antenna 100 of FIG. 1 tuned to three frequencies in a low-band according to one embodiment. The graph 400 shows the return loss 402 when the second frequency range of the second folded monopole structure 125 is tuned to be centered at approximately 1.77 GHz. The first frequency range can be tuned to radiate electromagnetic energy in DCS Band 3, for example. The graph 400 shows the return loss 404 when the second frequency range of the second folded monopole structure 125 is tuned to be centered at approximately 1.92 GHz. The first frequency range can be tuned to radiate electromagnetic energy in PCS Band 2, for example. The graph 400 shows the return loss 406 when the second frequency range of the second folded monopole structure 125 is tuned to be centered at approximately 2 GHz. The first frequency range can be tuned to radiate electromagnetic energy in Band 1.

In one embodiment, the dual-feed antenna 100 is configured to radiate electromagnetic energy at two resonant modes; a low-band resonant mode and a high-band resonant mode. The tuner circuits 150, 160 can be used to independently tune the low-band resonant mode and the high-band resonant mode, respectively. In one embodiment, the dual-feed antenna 100 covers approximately 700 MHz to approximately 960 MHz in the low-band and approximately 1.7 GHz to approximately 2.7 GHz in the high band. In another embodiment, the dual-feed antenna 100 covers approximately 700 MHz to approximately 960 MHz in the low-band and approximately 1.7 GHz to approximately 2.7 GHz in the high band. As described herein, other resonant modes may be achieved. Also, other frequency ranges may be covered by different designs of the dual-feed antenna as would be appreciated by one of ordinary skill in the art having the benefit of this disclosure. The terms "first," "second," "third," "fourth," etc., as used herein, are meant as labels to distinguish among different elements and may not necessarily have an ordinal meaning according to their numerical designation.

Figure 5:
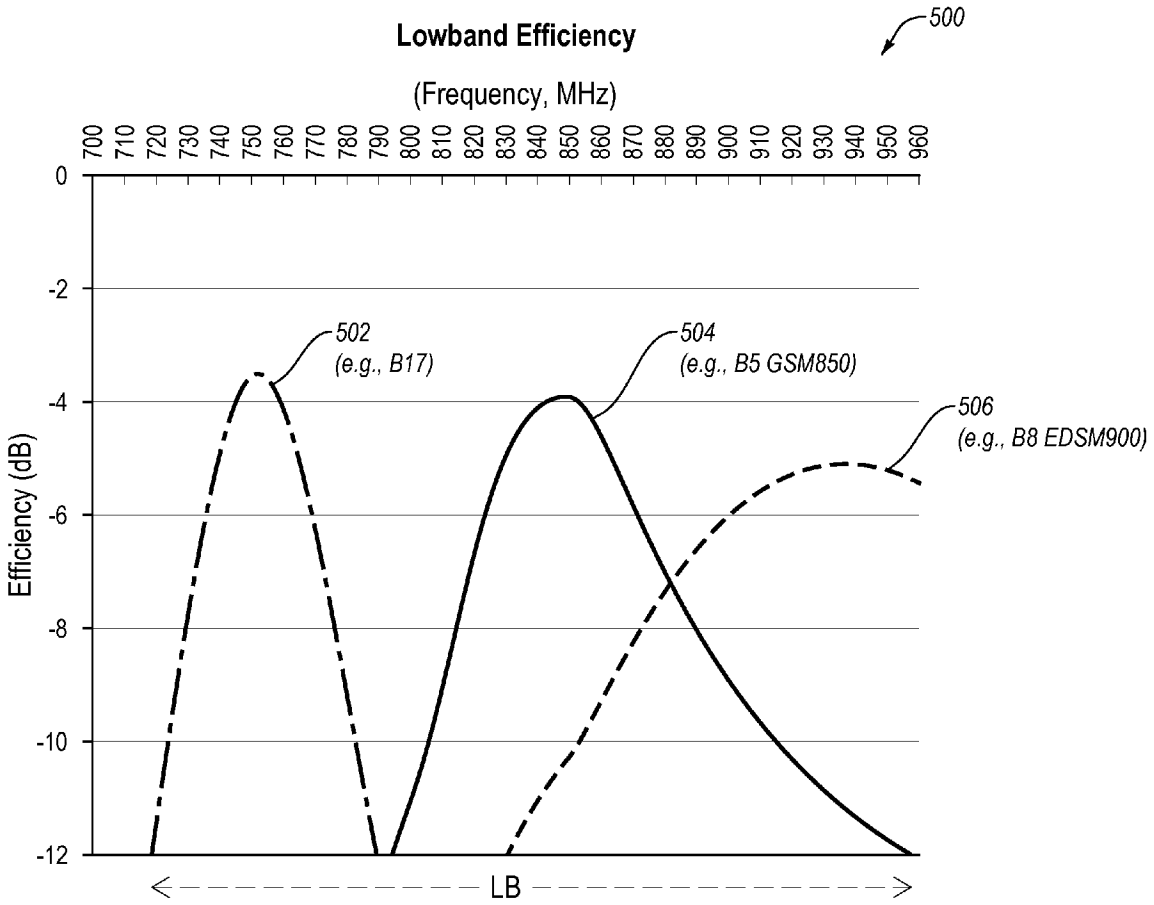
FIG. 5 is a graph of measured efficiencies of the first folded monopole structure of dual-feed antenna of FIG. 1 at the three frequencies in the low-band according to one embodiment.

FIG. 5 is a graph of measured efficiencies 502, 504, 506 of the first folded monopole structure 120 of dual-feed antenna of FIG. 1 at the three frequencies in the low-band according to one embodiment. The graph 500 shows the antenna efficiency 502 when the first frequency range of the first folded monopole structure 120 is tuned to be centered at approximately 740 MHz (e.g., Band 17). The graph 500 shows the antenna efficiency 504 when the first frequency range of the first folded monopole structure 120 is tuned to be centered at approximately 875 MHz (e.g., Band 5 GSM 850). The graph 500 shows the antenna efficiency 506 when the first frequency range of the first folded monopole structure 120 is tuned to be centered at approximately 925 MHz (e.g., Band 8 EGSM 900). The graph 500 illustrates that the dual-feed antenna 100 is a viable antenna for the respective frequency range in the low-band and that the first folded monopole structure 120 can be independently tuned from the second folded monopole structure 125.

Figure 6:
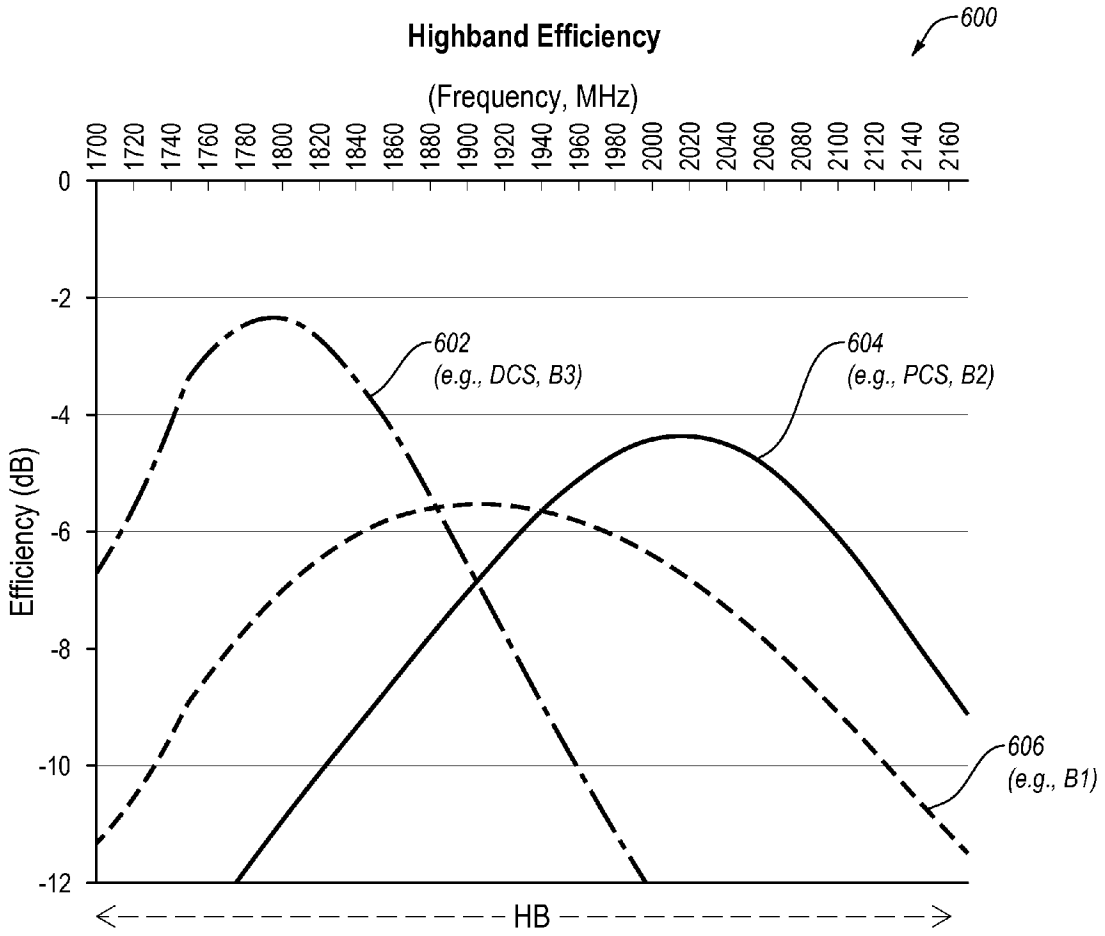
FIG. 6 is a graph of measured efficiencies of the second folded monopole structure of dual-feed antenna of FIG. 1 at the three frequencies in the high-band according to one embodiment.

FIG. 6 is a graph of measured efficiencies 602, 604, 606 of the second folded monopole structure 125 of dual-feed antenna of FIG. 1 at the three frequencies in the high-band according to one embodiment. The graph 600 shows the antenna efficiency 602 when the second frequency range of the second folded monopole structure 125 is tuned to be centered at approximately 1.77 GHz (e.g., DCS Band 3). The graph 600 shows the antenna efficiency 604 when the second frequency range of the second folded monopole structure 125 is tuned to be centered at approximately 1.92 GHz (e.g., PCS Band 2). The graph 600 shows the antenna efficiency 606 when the second frequency range of the second folded monopole structure 125 is tuned to be centered at approximately 2 GHz (e.g., Band 1). The graph 600 illustrates that the dual-feed antenna 100 is a viable antenna for the respective frequency range in the high-band and that the second folded monopole structure 125 can be independently tuned from the first folded monopole structure 120.

As described herein, when impedance tuning a single-feed antenna that is configured to radiate electromagnetic energy in all cellular bands, such as between approximately 700 MHz to approximately 960 MHz in the low-band and between approximately 1.7 GHz to approximately 2.2 GHz, changing the low-band impedance causes impedance change in the high-band impedance, or vice versa. The embodiments described herein independently tune the low-band impedance and the high-band impedance to minimize the negative impact on the other band, such as efficiency degradation due to antenna-to-antenna coupling and antenna-to-antenna mismatch. In one embodiment, the dual-feed antenna uses two signal narrowband resonance antennas; one for low-band (e.g., 700 MHz to 960 MHz) and the other one for high-band (e.g., 1.7 GHz to 2.2 GHz). The other one can also be expanded in the high-band (e.g., 1.7 GHz to 2.7 GHz). The two antennas can be in the same or different antenna carriers. The independent tuning capability of the two antennas can be achieved by dual-antenna feeds with dual impedance tuners (e.g., tuner circuits 150, 160, 200). Alternatively, this may be achieved for more than two antennas with multiple feeds with multiple impedance tuners. With the proper low-band antenna structure and high-band structure, there can be high isolation between the two antennas.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the dual-feed antenna may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

FIG. 7 illustrates another embodiment of a multi-feed antenna 700 including a monopole structure 720 (LB), a coupled monopole structure 725 (HB) and a loop structure 735 (MB) coupled to three independent tuner circuits 750, 760, and 770, respectively. In particular, the multi-feed antenna 700 includes the monopole structure 720 coupled to a first RF feed (LB feed) that is coupled to a first tuner circuit 750 (LB tuner). The multi-feed antenna 700 also includes the coupled monopole structure 725 coupled to a second RF feed (HB feed) that is coupled to a second tuner circuit 760 (HB tuner). The multi-feed antenna 700 also includes the loop structure 735 coupled to a third RF feed (MB feed) that is coupled to a third tuner circuit 760 (HB tuner). The ground is represented as a radiation ground plane 740 similar to the ground plane 140 described above Like the first RF feed 142 and second RF feed 142 of FIG. 1 described above, three RF feeds are used to feed the respective antenna elements. The multi-feed antenna 700 can be disposed on an antenna carrier 710 that is similar to the antenna carrier 110 described above. In this embodiment, the multi-feed antenna 700 is a 3D structure with some portions disposed on different sides of the antenna carrier 710. However, as described herein, the multi-feed antenna 700 may include 2D structures, as well as other variations than those depicted in FIG. 7.

During operation, the first tuner circuit 750 (LB tuner) is programmable to independently adjust a first impedance of the monopole structure 720 (LB antenna), the second tuner circuit 760 (HB tuner) is programmable to independently adjust a second impedance of the coupled monopole structure 7125 (HB antenna), and the third tuner circuit 770 (MB tuner) is programmable to independently adjust a third impedance of the loop structure 735 (MB antenna). The first, second and third impedances can be independently tuned to increase isolation between the monopole structure 720, coupled monopole structure 725 and loop structure 735.

In one embodiment, the monopole structure 720 is configured to radiate electromagnetic energy in a first frequency range (e.g., low-band), the coupled monopole structure 725 is configured to radiate electromagnetic energy in a second frequency range (e.g., high-band) and the loop structure 735 is configured to radiate electromagnetic energy in a third frequency range (e.g., mid-band). The third frequency range is higher than the first frequency range and the second frequency range is higher than the third frequency range. In one embodiment, the first frequency range is between approximately 700 MHz to approximately 960 MHz, the second frequency range is between approximately 2.3 GHz to approximately 2.7 GHz, and the third frequency range is between approximately 1.7 GHz to approximately 2.2 GHz. The embodiments described herein are not limited to use in these frequency ranges, but could be used to increase the bandwidth of a multi-band frequency in other frequency ranges, as described herein. The antenna structure may be configured to operate in multiple resonant modes, for example, a first high-band mode, a second high-band mode and a third mid-band mode.

In the depicted embodiment, the monopole structure 720 includes a first length that extends from the first RF feed to a distal end (not coupled to the ground plane 740). The coupled monopole structure 725 includes a second length that extends from the second RF feed to a distal end (not coupled to the ground plane 740). The loop structure 735 includes a third length that extends from a third RF feed to a distal end where the loop structure 735 is coupled to the ground plane 740. The first length is longer than the second length and the third length and the third length is longer than the second length. Although the first length is longer than the third length, in the depicted embodiment, a set of one or more tessellated fold patterns can be used to reduce a total width of the monopole structure 720, while maintaining an overall length of the monopole structure 720 to achieve a desired frequency.

The multi-feed antenna 100 may have various dimensions based on the various design factors. In one embodiment, the multi-feed antenna 700 has an overall height (h), an overall width (W), and an overall depth (d). The overall height (h) may vary, but, in one embodiment, is about 10 mm. The overall width (W) may vary, but, in one embodiment, is about 68 mm. The overall depth may vary, but, in one embodiment, is about 4 mm. The monopole structure 720 has a width ($W_1$) that may vary, but, in one embodiment, is 28 mm. The monopole structure 720 has a height ($h_1$) that may vary, but, in one embodiment, is 6 mm. The coupled monopole structure 725 a width ($W_4$) that may vary, but, in one embodiment, is 13 mm and a folded portion of the coupled monopole structure 725 has a second width ($W_2$) that may vary, but, in one embodiment, is 7 mm. The coupled monopole structure 725 a height ($h_2$) that may vary, but, in one embodiment, is 4 mm. The loop structure 735 has a width ($W_3$) that may vary, but, in one embodiment, is 28 mm. The loop structure 735 has a height ($h_3$) that may vary, but, in one embodiment, is 9 mm. The multi-feed antenna 700 may have a gap between the loop structure 735 and the monopole structure 720 with a width (not labeled) that may vary, but, in one embodiment, is 12 mm.

In one embodiment, the first antenna element is a monopole structure 720 that includes multiple portions: a first portion that extends from the first RF feed in a first direction to a first fold; a second portion that extends from the first fold in a second direction to a second fold; a third portion that extends from the second fold in a third direction to a third fold; a fourth portion that extends generally in the second direction from a distal end of the third portion. The fourth portion may include a set of one or more tessellated fold patterns that reduces a total width of the monopole structure 720, while maintaining an overall length of the antenna element to achieve a desired frequency. In the depicted embodiment, the fourth portion includes about nineteen folds that extend the fourth portion between two depths on a top side of the antenna carrier 710. The depicted embodiment also extends from the top side around a curved edge of the antenna carrier 710 to a side of the antenna carrier 710. This can be done to fit the monopole structure 720 in a smaller volume while maintaining the overall length of the monopole structure 720. The depicted embodiment, the second antenna element includes the coupled monopole structure 725. In the depicted embodiment, the coupled monopole structure 725 includes various portions: a fifth portion that extends from the second RF feed in the second direction to a fourth fold; a sixth portion that extends from the fourth fold in the first direction to a fifth fold; and a seventh portion that extends from the fifth fold in a third direction and is laid out at least partially in parallel to the fifth portion. A gap is between a distal end of the seventh portion and the ground plane, the distal end being the farthest from the second RF feed. The third antenna element includes the loop structure 735. In the depicted embodiment, the loop structure 735 includes various portions: an eight portion that extends from the third RF feed in the first direction to a sixth fold; a ninth portion that extends from the sixth fold in the third direction to a seventh fold; a tenth portion that extends from the seventh fold to an eighth fold; and an eleventh portion that extends towards the ground plane 740. In the depicted embodiment, the eleventh portion extends from the top side around a curved edge of the antenna carrier 710 to a side of the antenna carrier 710 to couple to the ground plane 740.

In this embodiment, the multi-feed antenna 700 is a 3D structure as illustrated in the perspective view of FIG. 7. In other embodiments, the monopole structure 720 and loop structure 735 are 3D structures that wrap around different sides of the antenna carrier 710 and the coupled monopole structure 725 is a 2D structure disposed on a front side of the antenna carrier 710. Of course, other variations of layout may be used as would be appreciated by one of ordinary skill in the art having the benefit of this disclosure.

In the depicted embodiment, the antenna types of the first, second and third antennas are different types; however, in other embodiments, the first, second and third antennas maybe the same type as described herein. It should also be noted that other shapes for the monopole structure 720 are possible. For example, the first antenna element 122 and the second antenna element 124 can have various bends, such as to accommodate placement of other components, such as a speakers, microphones, USB ports. Similarly, other shapes for the coupled monopole structure 725 may be used.

As described herein, strong resonances are not easily achieved within a compact space within user devices, especially within the spaces on smart phones and tablets. The structure of the multi-feed antenna 700 provides strong resonances at a first frequency range of 700 MHz to approximately 960 MHz, a second frequency range of approximately 1.7 GHz to approximately 2.2 GHz, and a third frequency range of approximately 2.3 GHz to approximately 2.7 GHz. Alternatively, the structure of the multi-feed antenna 700 provides strong resonances at other frequency ranges. These resonances can be operated in separate modes or may be operated simultaneously. These multiple strong resonances can provide an improved antenna design as compared to conventional designs.

In this embodiment, the multi-feed antenna 700 includes three antenna elements and three tuner circuits. In other embodiments, more antenna elements and tuner circuits can be used to configure the physical structure of a multi-feed antenna. The first tuner circuit 750 (LB tuner), second tuner circuit 760 (HB tuner) and third tuner circuit 770 (MB tuner) may be the tuner circuit 200 described above with respect to FIG. 2. Alternatively, other types of tuner circuits may be used for these three tuner circuits 750, 760, 770.

Figure 8:
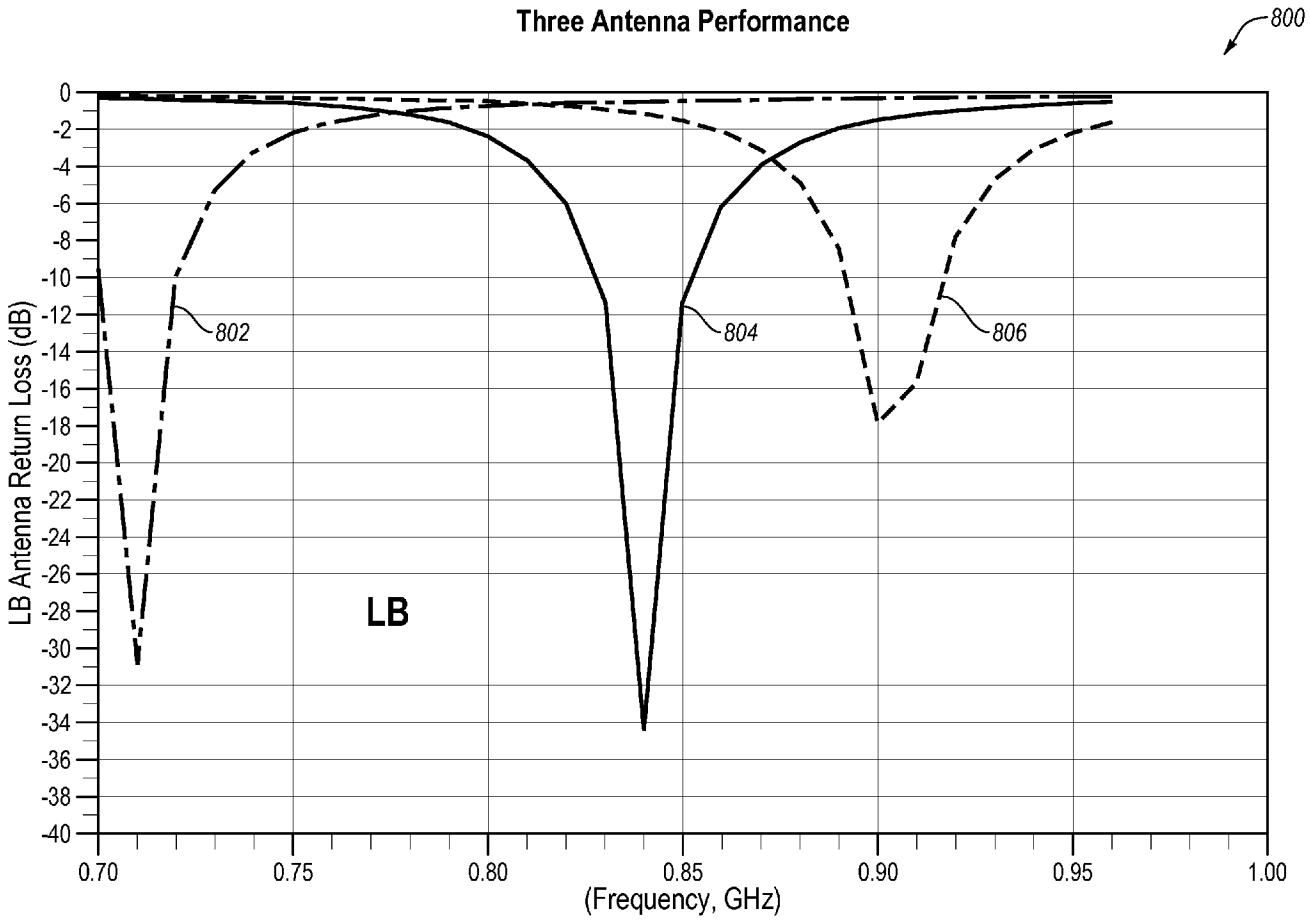
FIG. 8 is a graph of measured return loss of the monopole structure of the multi-feed antenna of FIG. 7 tuned to three frequencies in a low-band according to one embodiment.

FIG. 8 is a graph 800 of measured return loss 802, 804, 806 of the monopole structure 720 of the multi-feed antenna of FIG. 7 tuned to three frequencies in a low-band according to one embodiment. The graph 800 shows the return loss 802 when the first frequency range of the monopole structure 720 is tuned to be centered at approximately 710 MHz. The graph 800 shows the return loss 804 when the first frequency range of the monopole structure 720 is tuned to be centered at approximately 840 MHz. The graph 800 shows the return loss 806 when the first frequency range of the monopole structure 720 is tuned to be centered at approximately 900 MHz.

Figure 9:
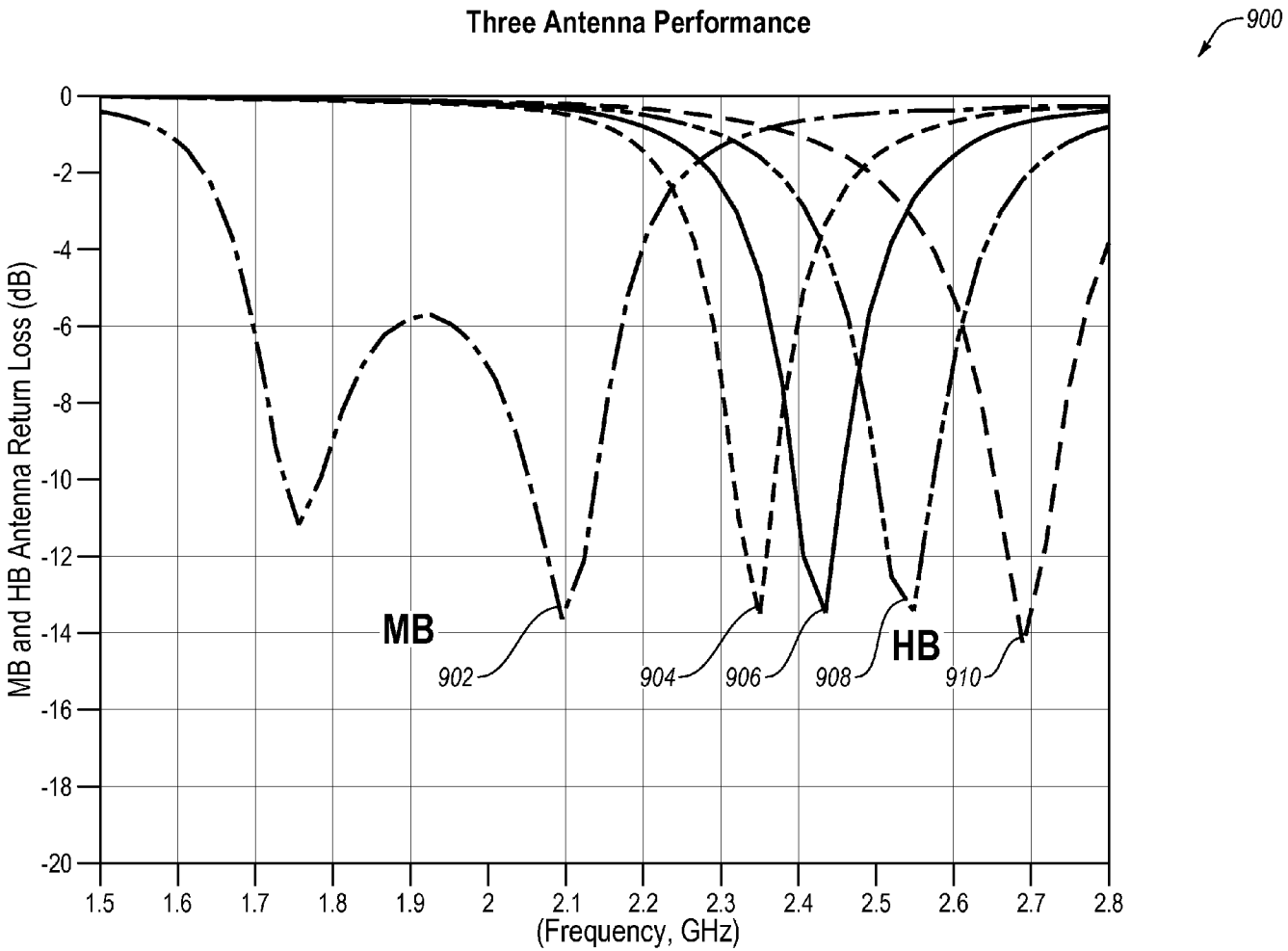
FIG. 9 is a graph of measured return loss of the coupled monopole structure of the multi-feed antenna of FIG. 7 tuned to four frequencies in a high-band according to one embodiment.

FIG. 9 is a graph 900 of measured return loss 904, 906, 908, 910 of the coupled monopole structure of the multi-feed antenna of FIG. 7 tuned to four frequencies in a high-band according to one embodiment. The graph 900 shows the return loss 904 when the second frequency range of the coupled monopole structure 725 is tuned to be centered at approximately 2.35 GHz. The graph 900 shows the return loss 906 when the second frequency range of the coupled monopole structure 725 is tuned to be centered at approximately 2.43 GHz. The graph 900 shows the return loss 908 when the second frequency range of the coupled monopole structure 725 is tuned to be centered at approximately 2.55 GHz. The graph 900 shows the return loss 910 when the second frequency range of the coupled monopole structure 725 is tuned to be centered at approximately 2.69 GHz. The graph 900 also shows the return loss 902 of the loop structure 735. The loop structure 735 creates two resonances in the mid-band; one centered at approximately 1.75 GHz and the other centered at approximately 2.1 GHz. In other embodiments, the loop structure 735 can be independently tuned from the monopole structure 720 and the coupled monopole structure 725.

Figure 10:
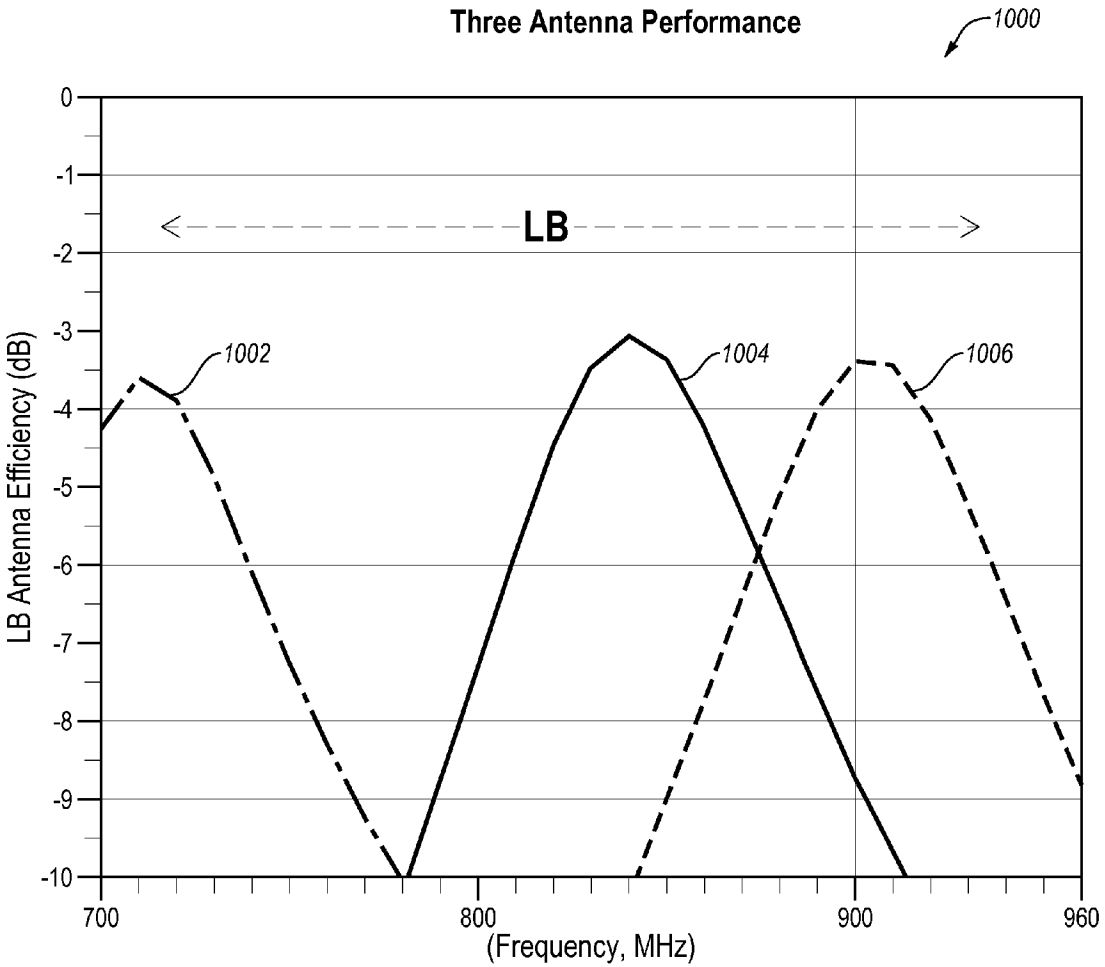
FIG. 10 is a graph of measured efficiencies of the monopole structure of multi-feed antenna of FIG. 7 at the three frequencies in the low-band according to one embodiment.

FIG. 10 is a graph 1000 of measured efficiencies of the monopole structure 720 of multi-feed antenna of FIG. 7 at the three frequencies in the low-band according to one embodiment. The graph 1000 shows the antenna efficiency 1002 when the first frequency range of the monopole structure 720 is tuned to be centered at approximately 710 MHz. The graph 1000 shows the antenna efficiency 1004 when the first frequency range of the monopole structure 720 is tuned to be centered at approximately 840 MHz. The graph 1000 shows the antenna efficiency 1006 when the first frequency range of the monopole structure 720 is tuned to be centered at approximately 900 MHz. The graph 1000 illustrates that the multi-feed antenna 700 is a viable antenna for the respective frequency range in the low-band and that the monopole structure 720 can be independently tuned from the coupled monopole structure 725 and the loop structure 735.

Figure 11:
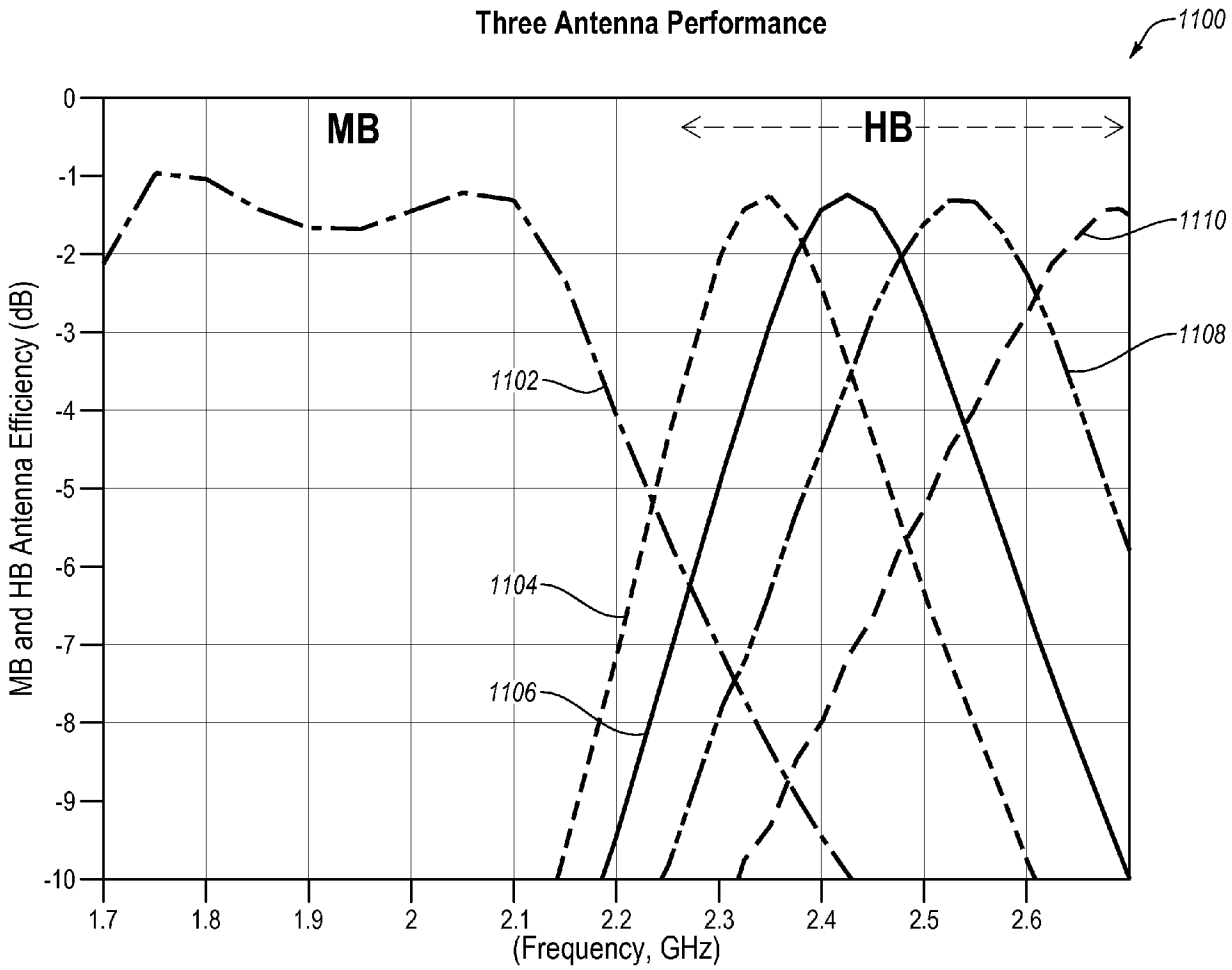
FIG. 11 is a graph of measured efficiencies of the coupled monopole structure of multi-feed antenna of FIG. 7 at the four frequencies in the high-band according to one embodiment.

FIG. 11 is a graph of measured efficiencies of the coupled monopole structure of multi-feed antenna of FIG. 7 at the four frequencies in the high-band according to one embodiment. The graph 1100 shows the antenna efficiency 1104 when the second frequency range of the coupled monopole structure 725 is tuned to be centered at approximately 2.35 GHz. The graph 1100 shows the antenna efficiency 1106 when the second frequency range of the coupled monopole structure 725 is tuned to be centered at approximately 2.43 GHz. The graph 1100 shows the antenna efficiency 1108 when the second frequency range of the coupled monopole structure 725 is tuned to be centered at approximately 2.55 GHz. The graph 1100 shows the antenna efficiency 1110 when the second frequency range of the coupled monopole structure 725 is tuned to be centered at approximately 2.69 GHz. The graph 1100 also shows the antenna efficiency 1102 of the loop structure 735. As described above, the loop structure 735 creates two resonances in the mid-band; one centered at approximately 1.75 GHz and the other centered at approximately 2.1 GHz.

Figure 12:
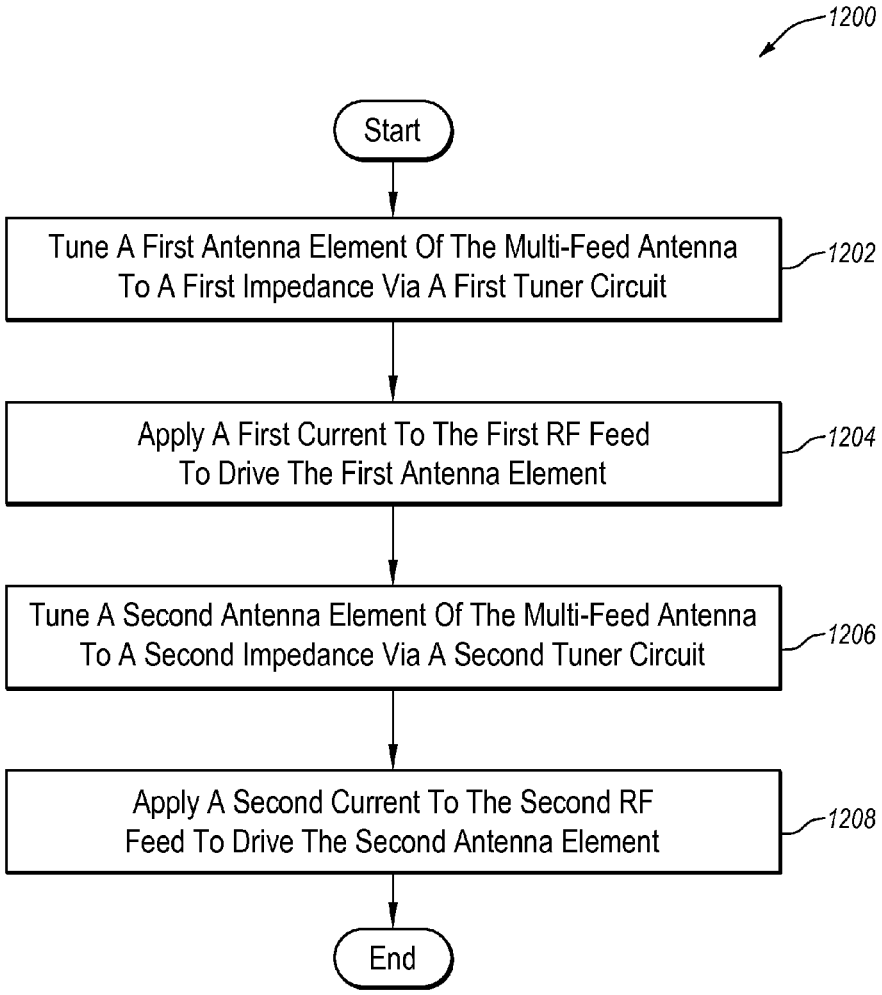
FIG. 12 is a flow diagram of an embodiment of a method of operating a user device having a multi-feed antenna according to one embodiment.

FIG. 12 is a flow diagram of an embodiment of a method 1200 of operating an electronic device having a multi-feed antenna according to one embodiment. In method 1200, an antenna structure (e.g., dual-feed antenna 100 or multi-feed antenna 700) is controlled, via tuner circuits. The method 1200 begins by adjusting a first impedance of a first antenna element of the multi-feed antenna (e.g., 100 or 700) via a first tuner circuit (block 1202). The first tuner circuit is coupled to a first RF feed that is coupled to the first antenna element. A first current is applied to the first antenna element via the first RF feed to drive the first antenna element (block 1204). In response to applying the first current, electromagnetic energy is radiated from the first antenna element. The method 1200 adjusts a second impedance of a second antenna element of the multi-feed antenna via a second tuner circuit (block 1206). The second tuner circuit is coupled to a second RF feed, which is coupled to the second antenna element. A second current is applied to the second antenna element via the second RF feed to drive the second antenna element (block 1208). In response to applying the second current, electromagnetic energy is radiated from the second antenna element. In one embodiment, the first current and second current are applied at least in part concurrently. Alternatively, the first current and second currents are applied at separate times.

In a further embodiment, the method 1200 adjust a third impedance of a third antenna element of the multi-feed antenna via a third tuner circuit. The third tuner circuit is coupled to a third RF feed, which is coupled to the third antenna element. A third current is applied to the third antenna element via the third RF feed to drive the third antenna element. In response to applying the third current, electromagnetic energy is radiated from the third antenna element.

In response to the applied current(s), when applicable, the antenna structure radiates electromagnetic energy to communicate information to one or more other devices. Regardless of the antenna configuration, the electromagnetic energy forms a radiation pattern. The radiation pattern may be various shapes as would be appreciated by one of ordinary skill in the art having the benefit of this disclosure.

The antenna structure of the multi-feed antenna can provide different resonant modes for various bands, such as a low-band, mid-band, high-band, or any combination thereof. For example, the first antenna element provides low-band resonant mode(s), and the second antenna element provides high-band resonant mode(s). For another example, the third antenna element may provide mid-band resonant mode(s). In one embodiment, the electromagnetic energy is radiated at a first frequency range of approximately 700 MHz to approximately 960 MHz and is radiated at a second frequency range of approximately 1.7 GHz to approximately 2.2 GHz. In another embodiment, the electromagnetic energy is radiated at a first frequency range of approximately 700 MHz to approximately 960 MHz and is radiated at a second frequency range of approximately 1.7 GHz to approximately 2.7 GHz. In another embodiment, the electromagnetic energy is radiated at a first frequency range of approximately 700 MHz to approximately 960 MHz, at a second frequency range of approximately 1.7 GHz to approximately 2.2 GHz, and at a third frequency range of approximately 2.3 GHz to approximately 2.7 GHz.

Figure 13:
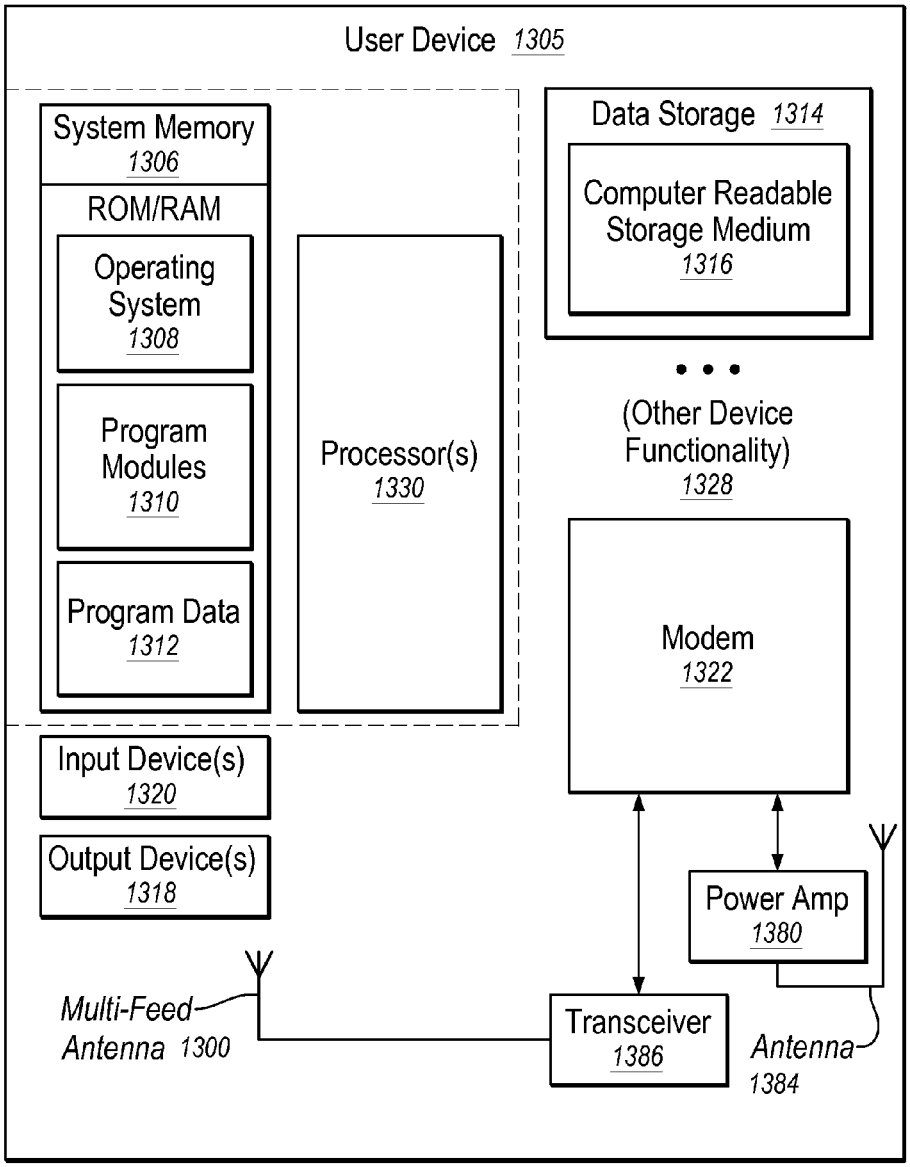
FIG. 13 is a block diagram of a user device having a multi-feed antenna according to one embodiment.

FIG. 13 is a block diagram of a user device 1305 having the multi-feed antenna 1300 according to one embodiment. The user device 1305 includes one or more processors 1330, such as one or more CPUs, microcontrollers, field programmable gate arrays, or other types of processing devices. The user device 1305 also includes system memory 1306, which may correspond to any combination of volatile and/or non-volatile storage mechanisms. The system memory 1306 stores information, which provides an operating system component 1308, various program modules 1310, program data 1312, and/or other components. The user device 1305 performs functions by using the processor(s) 1330 to execute instructions provided by the system memory 1306.

The user device 1305 also includes a data storage device 1314 that may be composed of one or more types of removable storage and/or one or more types of non-removable storage. The data storage device 1314 includes a computer-readable storage medium 1316 on which is stored one or more sets of instructions embodying any one or more of the functions of the user device 1305, as described herein. As shown, instructions may reside, completely or at least partially, within the computer readable storage medium 1316, system memory 1306 and/or within the processor(s) 1330 during execution thereof by the user device 1305, the system memory 1306 and the processor(s) 1330 also constituting computer-readable media. The user device 1305 may also include one or more input devices 1320 (keyboard, mouse device, specialized selection keys, etc.) and one or more output devices 1318 (displays, printers, audio output mechanisms, etc.).

The user device 1305 further includes a wireless modem 1322 to allow the user device 1305 to communicate via a wireless network (e.g., such as provided by a wireless communication system) with other computing devices, such as remote computers, an item providing system, and so forth. The wireless modem 1322 allows the user device 1305 to handle both voice and non-voice communications (such as communications for text messages, multimedia messages, media downloads, web browsing, etc.) with a wireless communication system. The wireless modem 1322 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WLAN (e.g., Wi-Fi® network), etc. In other embodiments, the wireless modem 1322 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1305 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1305 to communicate with other devices, such as other user devices, server computing systems, telephone devices, or the like. In addition to wirelessly connecting to a wireless communication system, the user device 1305 may also wirelessly connect with other user devices. For example, user device 1305 may form a wireless ad hoc (peer-to-peer) network with another user device.

The wireless modem 1322 may generate signals and send these signals to power amplifier (amp) 1380 or transceiver 1386 for amplification, after which they are wirelessly transmitted via the multi-feed antenna 1300 or antenna 1384, respectively. Although FIG. 13 illustrates power amp 1380 and transceiver 1386, in other embodiments, a transceiver may be used for all the antennas 1300 and 1384 to transmit and receive. Or, power amps can be used for both antennas 1300 and 1384. The antenna 1384, which is an optional antenna that is separate from the multi-feed antenna 1300, may be any directional, omnidirectional or non-directional antenna in a different frequency band than the frequency bands of the multi-feed antenna 1300. The antenna 1384 may also transmit information using different wireless communication protocols than the multi-feed antenna 1300. In addition to sending data, the multi-feed antenna 1300 and the antenna 1384 also receive data, which is sent to wireless modem 1322 and transferred to processor(s) 1330. It should be noted that, in other embodiments, the user device 1305 may include more or less components as illustrated in the block diagram of FIG. 13. In one embodiment, the multi-feed antenna 1300 is the dual-feed antenna 100 of FIG. 1. In another embodiment, the multi-feed antenna 1300 is the multi-feed antenna 500 of FIG. 5. Alternatively, the multi-feed antenna 1300 may be other multi-feed antennas as described herein.

In one embodiment, the user device 1305 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the multi-feed antenna 1300 that operates at a first frequency band and the second wireless connection is associated with a second resonant mode of the multi-feed antenna 1300 that operates at a second frequency band. In another embodiment, the first wireless connection is associated with the multi-feed antenna 1300 and the second wireless connection is associated with the antenna 1384. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1322 is shown to control transmission to both antennas 1300 and 1384, the user device 1305 may alternatively include multiple wireless modems, each of which is configured to transmit/receive data via a different antenna and/or wireless transmission protocol. In addition, the user device 1305, while illustrated with two antennas 1300 and 1384, may include more or fewer antennas in various embodiments.

The user device 1305 delivers and/or receives items, upgrades, and/or other information via the network. For example, the user device 1305 may download or receive items from an item providing system. The item providing system receives various requests, instructions and other data from the user device 1305 via the network. The item providing system may include one or more machines (e.g., one or more server computer systems, routers, gateways, etc.) that have processing and storage capabilities to provide the above functionality. Communication between the item providing system and the user device 1305 may be enabled via any communication infrastructure. One example of such an infrastructure includes a combination of a wide area network (WAN) and wireless infrastructure, which allows a user to use the user device 1305 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1305.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1305 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1305 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," "determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a first tuner circuit;

a first radio frequency (RF) feed coupled to the first tuner circuit;

a second tuner circuit;

a second RF feed coupled to the second tuner circuit; and a dual-feed antenna comprising:

a first folded monopole structure coupled to the first RF feed; and a second folded monopole structure coupled to the second RF feed, wherein the first tuner circuit is configured to independently adjust a first impedance of the first folded monopole structure to achieve a first frequency response, wherein the second tuner circuit is configured to independently adjust a second impedance of the second folded monopole structure to achieve a second frequency response substantially isolated from the first frequency response, wherein the first tuner circuit comprises:

a first switch comprising inputs coupled to ground and a first terminal;

a first capacitor coupled to an output of the first switch;

a first inductor coupled to the first capacitor and the first RF feed; and a second switch comprising a first input coupled to a second capacitor and a second inductor, wherein the second capacitor and the second inductor are coupled in parallel relative to ground, wherein the second switch further comprises a second input coupled to a third capacitor and a third inductor that are coupled in series to ground, wherein an output of the second switch is coupled in parallel to the first terminal, and wherein at least one of the first capacitor, second capacitor and third capacitor is a tunable capacitor.

2. The electronic device of claim 1, wherein the first folded monopole structure comprises a first length that extends from the first RF feed to a first grounding point where the first folded monopole is coupled to a ground plane, wherein the second folded monopole structure comprises a second length that extends from the second RF feed to a second grounding point where the second folded monopole structure is coupled to the ground plane, and wherein the first length is longer than the second length.

3. The electronic device of claim 1, wherein the first folded monopole structure is configured to radiate electromagnetic energy in a first frequency range and the second folded monopole structure is configured to radiate electromagnetic energy in a second frequency range, which is higher than the first frequency range.

4. The electronic device of claim 1, wherein the first tuner circuit comprises a plurality of passive components and one or more switches to selectively couple the plurality of passive components to adjust the first impedance.

5. An apparatus comprising:

a first tuner circuit;

a first radio frequency (RF) feed coupled to the first tuner circuit;

a second tuner circuit;

a second RF feed coupled to the second tuner circuit; and an antenna structure comprising:

a first antenna element coupled to the first RF feed; and a second antenna element coupled to the second RF feed, wherein the first tuner circuit is programmable to independently adjust a first impedance of the first antenna element and the second tuner circuit is programmable to independently adjust a second impedance of the second antenna element, wherein the first tuner circuit comprises:

a first switch comprising inputs coupled to ground and a first terminal a first capacitor coupled to an output of the first switch;

a first inductor coupled to the first capacitor and the first RF feed; and a second switch comprising a first input coupled to a second capacitor and a second inductor, wherein the second capacitor and the second inductor are coupled in parallel relative to ground, wherein the second switch further comprises a second input coupled to a third capacitor and a third inductor that are coupled in series to ground, wherein an output of the second switch is coupled in parallel to the first terminal, and wherein at least one of the first capacitor, second capacitor and third capacitor is a tunable capacitor.

6. The apparatus of claim 5, wherein the first antenna element is a first folded monopole structure and the second antenna element is a second folded monopole structure.

7. The apparatus of claim 5, wherein the first antenna element is configured to radiate electromagnetic energy in a first frequency range and the second antenna element is configured to radiate electromagnetic energy in a second frequency range, wherein the second frequency range is higher than the first frequency range.

8. The apparatus of claim 7, wherein the first frequency range is approximately 700 MHz to approximately 960 MHz and the second frequency range is approximately 1.7 GHz to approximately 2.2 GHz.

9. The apparatus of claim 5, further comprising:

a third tuner circuit; and a third RF feed coupled to the third tuner circuit, and wherein the antenna structure further comprises a third antenna element coupled to the third RF feed, wherein the third tuner circuit is programmable to independently adjust a third impedance of the third antenna element.

10. The apparatus of claim 9, wherein the first antenna element is a monopole structure, the second antenna element is a loop structure and the third antenna element is a coupled monopole structure.

11. The apparatus of claim 9, wherein the first antenna element is configured to radiate electromagnetic energy in a first frequency range, the second antenna element is configured to radiate electromagnetic energy in a second frequency range and the third antenna element is configured to radiate electromagnetic energy in a third frequency range, and wherein the second frequency range is higher than the first frequency range and the third frequency range is higher than the second frequency range.

12. The apparatus of claim 11, wherein the first frequency range is approximately 700 MHz to approximately 960 MHz, the second frequency range is approximately 1.7 GHz to approximately 2.2 GHz, and the third frequency range is approximately 2.3 GHz to approximately 2.7 GHz.

13. The apparatus of claim 5, wherein the first tuner circuit comprises:

a plurality of passive components; and one or more switches coupled to the plurality of passive components, wherein the one or more switches are programmable to couple the plurality of passive components in different configurations to adjust the first impedance.

14. The apparatus of claim 5, wherein the first antenna element comprises a folded monopole structure, wherein the folded monopole structure further comprises:

a first portion that extends from the first RF feed in a first direction to a first fold;

a second portion that extends from the first fold in a second direction to a second fold;

a third portion that extends from the second fold in a third direction to a third fold;

a fourth portion that extends from the third fold in a fourth direction to a fourth fold and is laid out at least partially in parallel to the second portion; and a fifth portion that extends from the fourth fold in a fifth direction to a ground plane and is laid out at least partially in parallel to the first portion, and wherein the first tuner circuit is disposed at a proximal end of the first portion, the proximal end being nearest to the first RF feed.

15. The apparatus of claim 14, wherein a section of a distal end of the folded monopole structure is folded in the third direction towards the ground plane.

16. The apparatus of claim 5, wherein the second antenna element comprises a folded monopole structure, wherein the folded monopole structure further comprises:

a first portion that extends from the first RF feed in a first direction to a first fold;

a second portion that extends from the first fold in a second direction to a second fold;

a third portion that extends from the second fold in a third direction to a third fold;

a fourth portion that extends from the third fold in a fourth direction to a fourth fold and is laid out at least partially in parallel to the second portion; and a fifth portion that extends from the fourth fold in a fifth direction to a ground plane and is laid out at least partially in parallel to the first portion, and wherein the second tuner circuit is disposed at a proximal end of the first portion, the proximal end being nearest to the second RF feed.

17. The apparatus of claim 9, wherein the first antenna element is a monopole structure, the second antenna element is a loop structure and the third antenna element is a coupled monopole structure, wherein the monopole structure comprises:

a first portion that extends from the first RF feed in a first direction to a first fold;

a second portion that extends from the first fold in a second direction to a second fold;

a third portion that extends from the second fold in a third direction to a third fold; and a fourth portion that extends in the second direction from a distal end of the third portion, wherein the fourth portion comprises a set of tessellated fold patterns, and wherein the coupled monopole structure comprises:

a fifth portion that extends from the third RF feed in the second direction to a fourth fold;

a sixth portion that extends from the fourth fold in the first direction to a fifth fold; and a seventh portion that extends from the fifth fold in a third direction and is laid out at least partially in parallel to the fifth portion.

18. A method of operating an electronic device, the method comprising:

adjusting a first impedance of a first antenna element of a multi-feed antenna via a first tuner circuit, the first tuner circuit being coupled to a first radio frequency (RF) feed at a first terminal and to the first antenna element at a first node, wherein adjusting the first impedance comprises selectively coupling at least one of:

a first tunable matching network of parallel components, the first tunable matching network being selectively coupled between the first terminal and a ground node via a first switch;

a second tunable matching network of series components, the second tunable matching network being selectively coupled between the first terminal and the ground node via the first switch;

a third tunable matching network of series components, the third tunable matching network being coupled between the first terminal and the first node via a second switch;

applying a first current to the first RF feed to drive the first antenna element;

adjusting a second impedance of a second antenna element of the multi-feed antenna via a second tuner circuit, the second tuner circuit being coupled to a second RF feed, wherein the second RF feed is coupled to the second antenna element; and applying a second current to the second RF feed to drive the second antenna element.

19. The method of claim 18, further comprising:

adjusting a third impedance of a third antenna element of the multi-feed antenna via a third tuner circuit, the third tuner circuit being coupled to a third RF feed, wherein the third RF feed is coupled to the third antenna element; and applying a third current to the third RF feed to drive the third antenna element.

20. The method of claim 18, wherein the applying the first current and the applying the second current are done at least in part concurrently.

* * * * *